US009936765B2

(12) United States Patent
Sato et al.

(10) Patent No.: US 9,936,765 B2
(45) Date of Patent: Apr. 10, 2018

(54) SOLE STRUCTURE FOR A SHOE

(71) Applicant: Mizuno Corporation, Osaka-shi (JP)

(72) Inventors: Natsuki Sato, Portland, OR (US); Takao Oda, Takarazuka (JP); Takeshi Takeshita, Osaka (JP); Shogo Matsui, Osaka (JP)

(73) Assignee: Mizuno Corporation, Osaka-shi (JP)

( * ) Notice: Subject to any disclaimer, the term of this patent is extended or adjusted under 35 U.S.C. 154(b) by 0 days.

(21) Appl. No.: 15/209,830

(22) Filed: Jul. 14, 2016

(65) Prior Publication Data

US 2017/0035143 A1 Feb. 9, 2017

(30) Foreign Application Priority Data

Aug. 7, 2015 (JP) ..... 2015-156770

(51) Int. Cl.

| | |
|---|---|
| ***A43B 13/18*** | (2006.01) |
| ***A43B 7/14*** | (2006.01) |
| ***A43B 13/04*** | (2006.01) |
| ***A43B 13/12*** | (2006.01) |

(52) U.S. Cl.

CPC ..... *A43B 13/186* (2013.01); *A43B 7/143* (2013.01); *A43B 7/148* (2013.01); *A43B 13/04* (2013.01); *A43B 13/125* (2013.01); *A43B 13/188* (2013.01)

(58) Field of Classification Search

CPC ..... A43B 13/18; A43B 13/181; A43B 13/183; A43B 13/186; A43B 13/188; A43B 13/125

USPC ..... 36/30 R, 28, 25 R, 103

See application file for complete search history.

(56) References Cited

U.S. PATENT DOCUMENTS

| | | | | |
|---|---|---|---|---|
| 7,484,317 | B2 | 2/2009 | Kita et al. | |
| 8,549,773 | B2 | 10/2013 | Nakatsuka | |
| 2008/0052965 | A1* | 3/2008 | Sato | A43B 13/026 36/103 |
| 2009/0013556 | A1* | 1/2009 | Nishiwaki | A43B 13/181 36/28 |
| 2014/0115925 | A1* | 5/2014 | Hurd | A43B 13/122 36/103 |

(Continued)

FOREIGN PATENT DOCUMENTS

| | | |
|---|---|---|
| JP | 2010-162318 A | 7/2010 |
| WO | WO 2006/129837 | 12/2006 |
| WO | WO 2014/028937 | 2/2014 |

OTHER PUBLICATIONS

Japanese Office Action in Japanese Patent Application No. 2015-156770, dated Jan. 15, 2018, 4 pages, with partial English translation, 4 pages.

*Primary Examiner* — Ted Kavanaugh
(74) *Attorney, Agent, or Firm* — W. F. Fasse

(57) ABSTRACT

A sole structure for a shoe that can reduce the burden of MP joints and a knee joint of a shoe wearer's foot during running and that can improve cushioning properties. The sole structure of the shoe includes an upper plate of a hard elastic member disposed at a forefoot region of the shoe, a lower plate of a hard elastic member disposed under and spaced away from the upper plate, and a midsole of a soft elastic member interposed between the upper plate and the lower plate. The midsole has a longitudinally extending hollow portion that is upwardly concavely curved at a lateral mid-portion of the midsole. The lower plate has a concave portion corresponding to the hollow portion of the midsole.

20 Claims, 12 Drawing Sheets

(56) References Cited

U.S. PATENT DOCUMENTS

| | | | | |
|---|---|---|---|---|
| 2017/0105480 | A1* | 4/2017 | Hurd | A43B 13/185 |
| 2017/0188659 | A1* | 7/2017 | Elder | A43B 13/141 |

* cited by examiner

SOLE STRUCTURE FOR A SHOE

FIELD OF THE INVENTION

The present invention relates generally to a sole structure for a shoe, and more particularly, to an improved structure that can reduce the burden of MP joints (i.e. Metatarsophalangeal joints) and a knee joint of a shoe wearer's foot during running and that can improve cushioning properties.

BACKGROUND INFORMATION

Japanese patent application publication No. 2010-162318 (hereinafter referred to JP '318) discloses a sole structure for a shoe with a leaf spring structure that is composed of a hard treading plate extending from the heel portion to the forefoot portion and a hard ground-contact plate located away from the treading plate and extending from the heel portion to the forefoot portion and in which the treading plate and the ground-contact plate are coupled to each other at the heel portion (see para. [0010] and FIG. 1). According to the description of JP '318, when an external force to narrow a gap between the treading plate and the ground-contact plate is applied, the leaf spring structure generates a restoration force thereby causing a strong kick at the time of push-off motion of the foot (see para. [0018] and FIGS. 2-5).

WO2006/129837 (hereinafter referred to WO '837) discloses a sole structure that comprises an upper plate disposed on an upper side and extending from the heel region to the forefoot region, a lower plate disposed under and coupled to the upper plate via an elastic block and having a wavy corrugated shape formed of two downwardly convexly protruding parts at the heel region and an undulation at the forefoot region (see line 19 of page 10 to line 16 of page 14, and FIGS. 1A, 1B and 2). According to such a sole structure, at the time of striking onto the ground, a void formed at the heel region can generate cushioning properties and the wavy corrugated shape of the lower plate can improve bending properties.

In the sole structure described in JP '318, during the push-off motion of the foot, a gap between the treading plate and the ground-contact plate at the toe portion is narrowed, and the heel portion of the shoe is disengaged from the treading plate (see para. [0018] and FIG. 4). At this juncture, as can be seen from comparison between the shoe in FIG. 4 and the shoes in FIGS. 1-3 and 5, in the state immediately before the push-off motion of the foot shown in FIG. 4, a forefoot region of an shoe upper bends. Because unless the forefoot region of the shoe upper bends the gap (see FIG. 4) is not created between a heel region of the shoe upper and the treading plate. Therefore, in the structure of JP '318, during the push-off motion of the foot, as the forefoot region of the shoe upper bends MP joints (i.e. Metatarsophalangeal joints) of the foot bends.

In the sole structure described in WO '837, since the lower plate has the undulation formed at the forefoot region, during the push-off motion of the foot, as the lower plate bends along the undulation the forefoot region bends. Therefore, in the structure of WO '837 as well, during the push-off motion of the foot, as the forefoot region bends the MP joints of the foot bends.

At this point, especially, in the case of a person of a large constitution, when such a weighty person runs, if he/she uses MP joints during every push-off motion of the foot, the burden on the MP joints becomes large. Also, when bending the MP joints he/she uses a knee joint as well, thus increasing the burden on the knee joint too. On the other hand, it is considered that when running slowly, if there is not a problem of the interconnection with the motion of the foot, the burden on the MP joints and the knee joint can be reduced by conversely restraining bending of the MP joints. In this case, if cushioning properties of the forefoot region are insufficient there is a risk that foot joints and the knee joint are injured.

The present invention has been made in view of these circumstances and its object is to provide a sole structure for a shoe that can reduce the burden of MP joints and a knee joint of a shoe wearer's foot during running and that can improve cushioning properties. Also, the present invention is directed to providing a sole structure for a shoe in which especially a person of a large constitution can run without imposing a burden on the body when he/she runs slowly.

Other objects and advantages of the present invention will be obvious and appear hereinafter.

SUMMARY OF THE INVENTION

A sole structure for a shoe according to the present invention includes an upper plate disposed at least at a forefoot region of the shoe, a lower plate disposed under and spaced away from the upper plate, and a midsole that is interposed between the upper plate and the lower plate and that is softer than the upper plate and the lower plate. The midsole has a hollow portion that is upwardly concavely curved (i.e. a concave side of the curve faces downwardly and a convex side of the curve faces upwardly) at a lateral or transverse mid-portion thereof (i.e. a portion at a middle in a transverse direction of the shoe) and that extends longitudinally in a longitudinal direction of the shoe.

According to the present invention, since the midsole has the longitudinally extending hollow portion that curves upwardly concavely at the lateral mid-portion at least at the forefoot region of the shoe and the upper and lower plates are provided above and below the midsole, the forefoot region of the midsole is restrained from bending and the forefoot region of the sole structure is thus restrained from bending, thereby restraining the MP joints from bending during running to reduce the burden on the MP joints and the knee joint. As a result of this, especially, when a person of a large constitution runs slowly he/she can easily run using muscles of a relatively large output around the hip joint and he/she will thus be able to run without imposing the burden on the body. Moreover, in this case, the soft midsole is provided between the upper and lower plates, thereby improving the cushioning properties when the load is transferred to the forefoot region.

The lower plate may have a concave portion that corresponds to the hollow portion of the midsole. In this case, bending of the forefoot region of the sole structure can be further restrained by the concave portion of the lower plate that is relatively harder than the midsole.

The lower plate and the midsole may have a pair of flat surfaces at laterally (i.e. transversely) opposite ends (i.e. sides) thereof. In this case, load applied to the forefoot region can be stably supported by the flat surfaces at the laterally or transversely opposite ends or sides of the lower plate and the midsole.

The upper plate may extend laterally or transversely in a flat shape at a lateral or transverse mid-portion.

A front end of the hollow portion of the midsole may extend to a position corresponding to distal ends of metatarsi of a third toe and a fourth toe of a shoe wearer's foot. In this case, bending at the metatarsophalangeal joints of the forefoot region can be securely restrained.

A front end of the hollow portion of the midsole may extend to a tip end of a toe of the shoe wearer's foot.

A rear end of the hollow portion of the midsole may extend to a rear end of the forefoot region.

The midsole may extend to a midfoot region of the shoe and a rear end of the hollow portion of the midsole may extend to the midfoot region.

The lower plate may have a groove or a slit that extends longitudinally.

A toe spring of the shoe may be 20 to 60 mm. In such a way, by setting up the toe spring at a relatively high value, an angle of the foot can vary according to weight transfer even when bending of the MP joints is restrained. The shoe wearer will thus be able to run in a smooth manner without breaking the interconnection with the motion of the foot.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
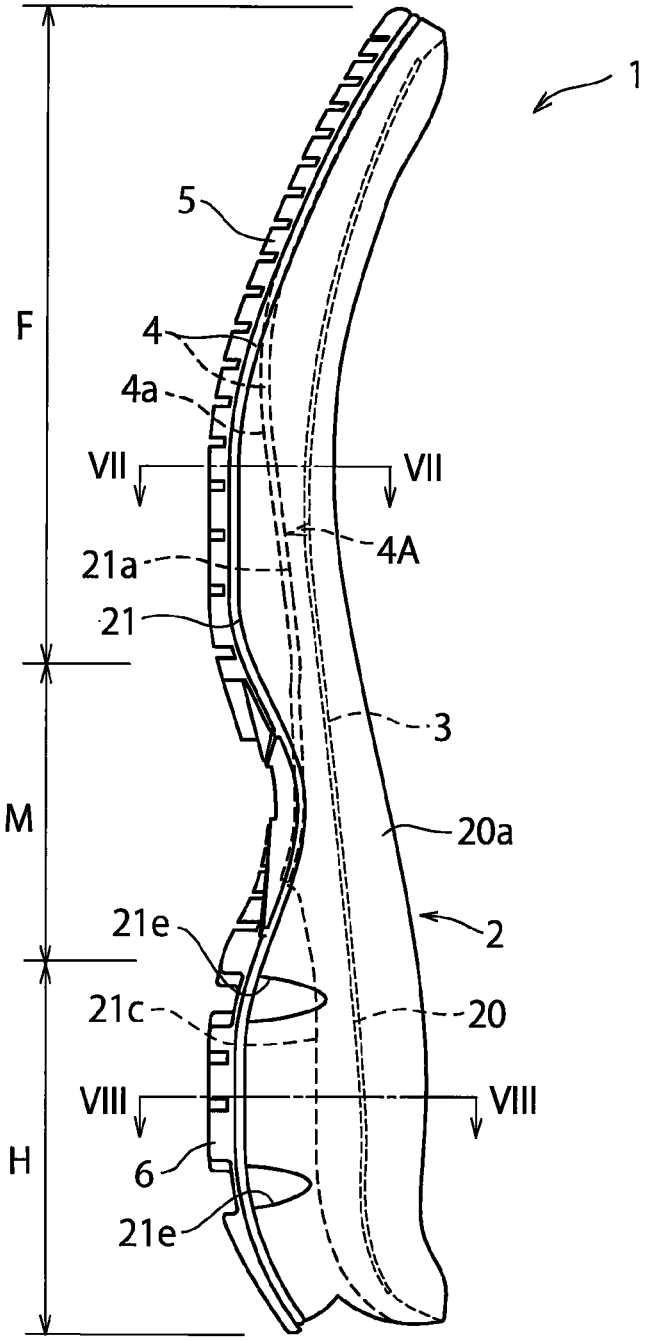
FIG. 1 is a lateral side schematic view of the sole structure (for a left foot) according to an embodiment of the present invention.
Figure 5:
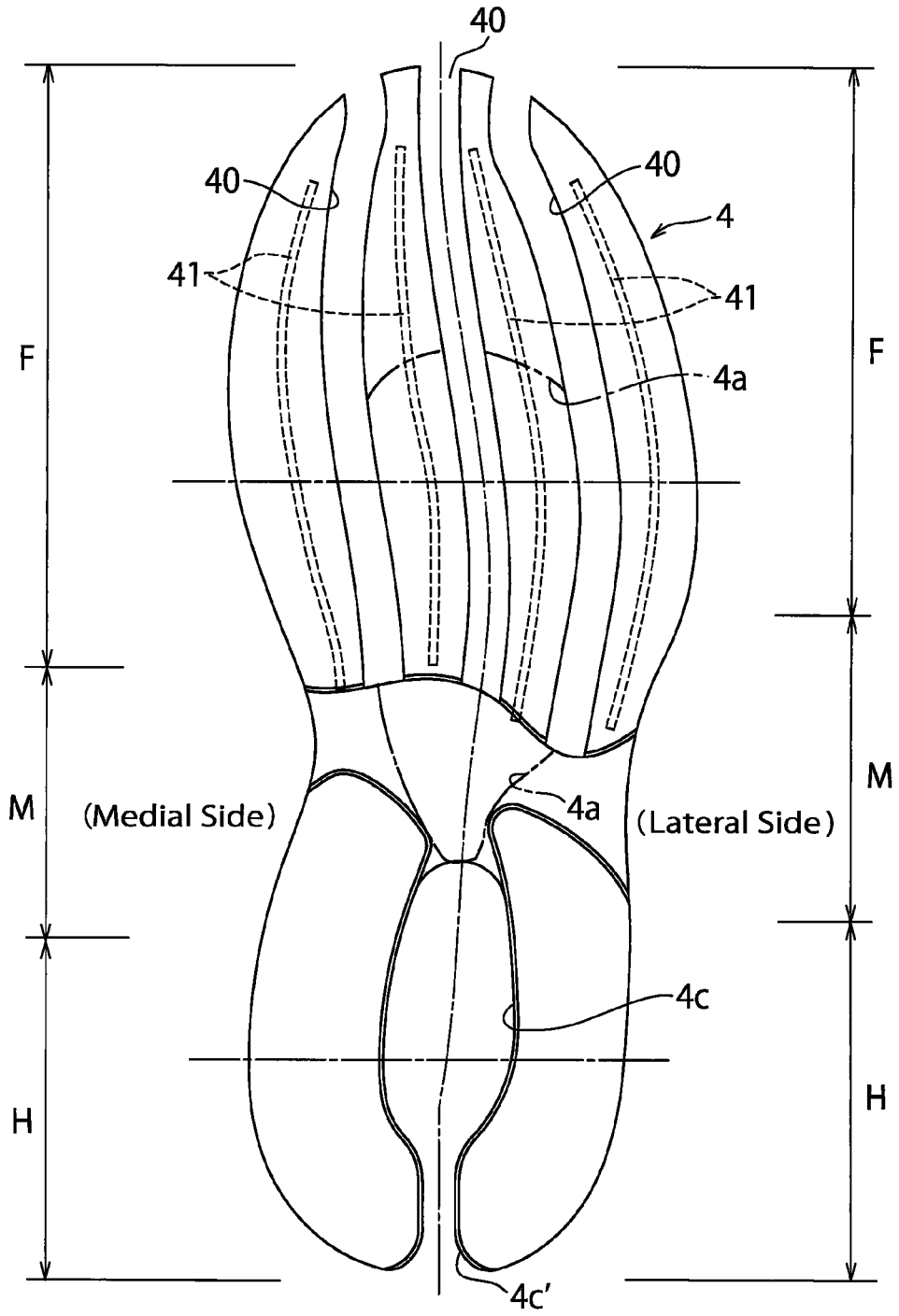
FIG. 5 is a bottom schematic view of the lower plate constituting the sole structure of FIG. 1, illustrating the state in which the outsole, midsole and upper plate were removed from the structure of FIG. 4.
Figure 6:
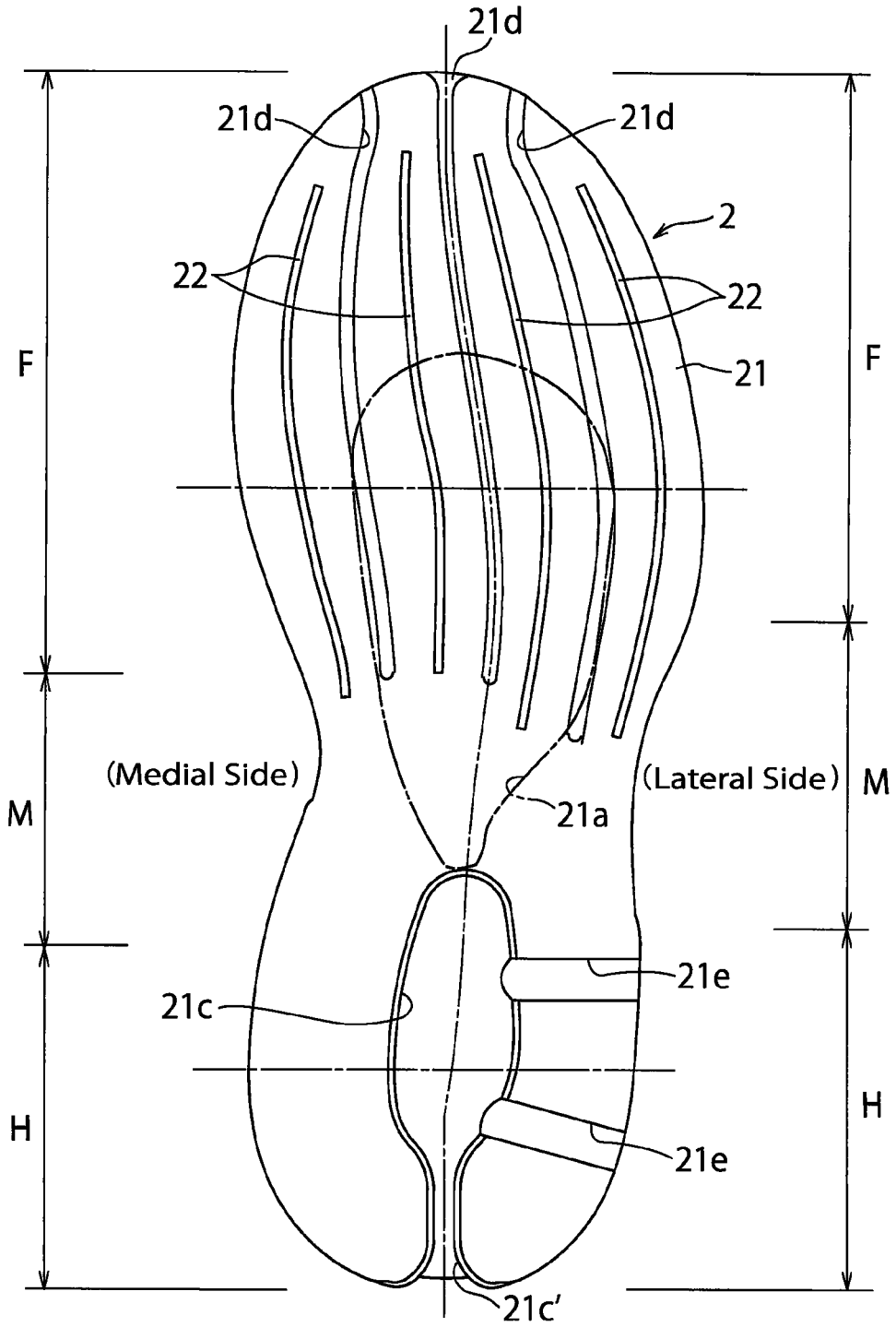
FIG. 6 is a bottom schematic view of the midsole constituting the sole structure of FIG. 1, illustrating the state in which the outsole, and the upper and lower plates were removed from the structure of FIG. 4.
Figure 7:
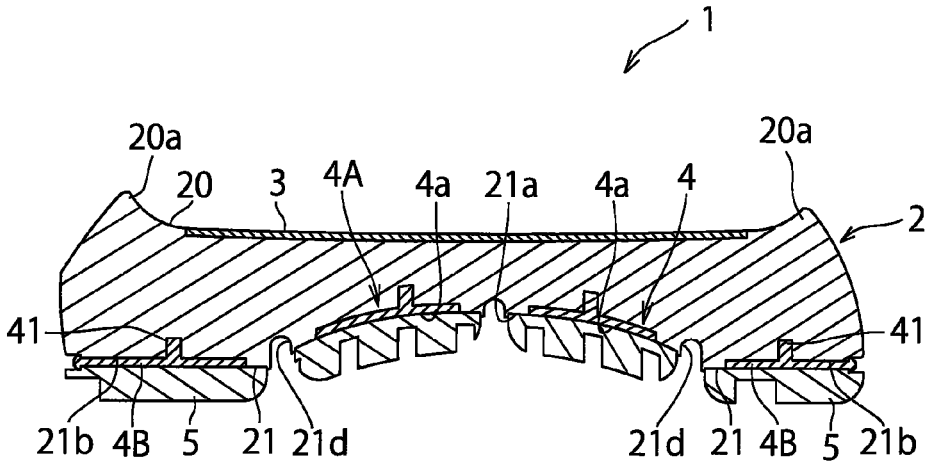
FIG. 7 is a cross sectional view of FIGS. 1 to 4 taken along line VII-VII.
Figure 8:
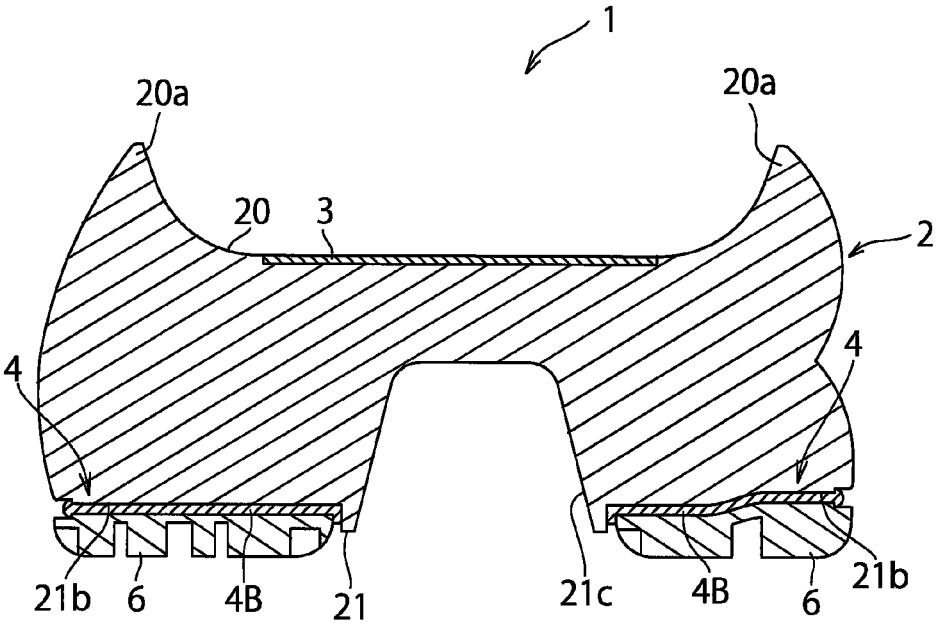
FIG. 8 is a cross sectional view of FIGS. 1 to 4 and 10 taken along line VIII-VIII.

Referring now to the drawings, FIGS. 1 to 9 show a sole structure for a shoe according to an embodiment of the present invention. Here, a running shoe is taken as an example. In the following explanation, "upward (upper side/upper)" and "downward (lower side/lower)" designate an upward direction and a downward direction of the shoe, respectively, "forward (front side/front)" and "rearward (rear side/rear)" designate a forward direction and a rearward direction (i.e. forward and rearward longitudinal directions) of the shoe, respectively, and "a width or lateral or transverse direction" designates a crosswise or transverse direction of the shoe that extends transversely relative to the longitudinal direction. That is to say, when FIG. 1 is taken as an example, upward and downward designate right direction and left direction of FIG. 1, respectively, forward and rearward designate upper and lower portions or directions of the page of FIG. 1, respectively, and width or lateral direction designates the direction into the page of FIG. 1. In the drawings, reference characters H, M and F indicate a heel region, a midfoot region and a forefoot region, respectively. In addition, FIG. 7 is a cross sectional view of FIGS. 1 to 4 taken along line VII-VII and FIG. 8 is a cross sectional view of FIGS. 1 to 4 taken along line VIII-VIII, but in FIGS. 5, 6 and 9, positions corresponding to the lines VII-VII and VIII-VIII of FIGS. 1 to 4 are shown in dash-and-dot-lines.

Figure 2:
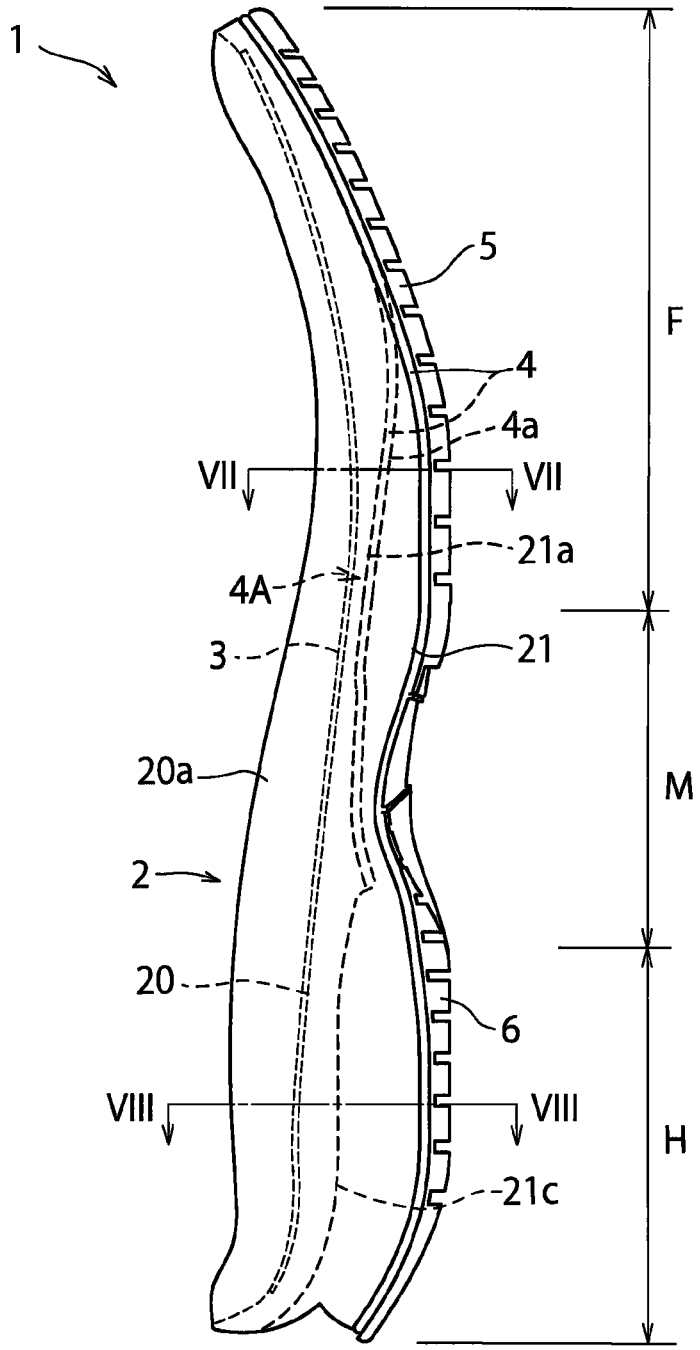
FIG. 2 is a medial side schematic view of the sole structure of FIG. 1.
Figure 3:
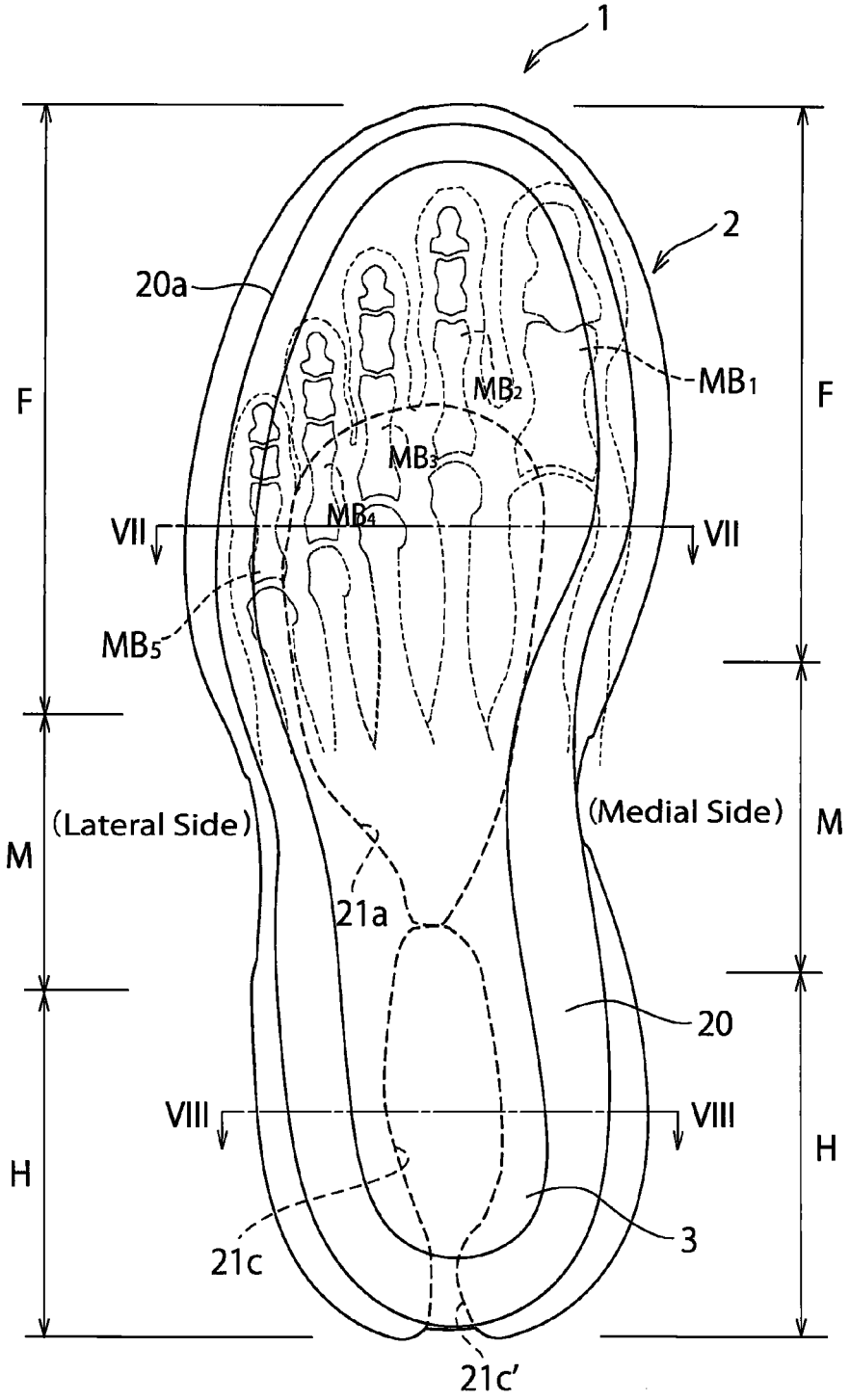
FIG. 3 illustrates a top plan schematic view of the sole structure of FIG. 1 along with a portion of a bone structure of a foot.

As shown in FIGS. 1 to 3, a sole structure 1 according to an embodiment of the present invention includes a midsole 2 extending from the heel region H through the midfoot region M to the forefoot region F of the shoe. As shown in FIGS. 3, 6 and 7, the midsole 2 extends in a transverse direction, e.g. continuously, along an entire width of the forefoot region F of the shoe. The midsole 2 is formed of a member having cushioning properties and has a foot sole contact surface 20 on an upper surface side that a sole of a shoe wearer's foot comes into contact with. The foot sole contact surface 20 has an upraised portion 20*a* around a perimeter thereof that is disposed along an outer circumferential edge portion of the foot sole contact surface 20 and that extends upwardly (see FIGS. 7 and 8).

On the foot sole contact surface 20 of the midsole 2, there is provided an upper plate 3 formed of a thin plate-like member or sheet-like member. The upper plate 3 extends from the heel region H through the midfoot region M to the forefoot region F of the shoe and is fixedly attached to the foot sole contact surface 20 of the midsole 2 or a stepped portion formed on the foot sole contact surface 20 through bonding and the like. On a bottom surface 21 on the lower side of the midsole 2, there is provided a lower plate 4 formed of a relatively thin plate-like member or sheet-like member. As with the upper plate 3, the lower plate 4 also extends from the heel region H through the midfoot region M to the forefoot region F of the shoe and is fixedly attached to the bottom surface 21 of the midsole 2 or a stepped portion formed on the bottom surface 21 through bonding and the like. The midsole 2 is sandwiched between the upper plate 3 and the lower plate 4 (see FIGS. 7 and 8). On a lower surface of the lower plate 4, there are provided outsoles 5, 6 that respectively have a ground contact surface to come into contact with the ground (see FIG. 4). The outsole 5 is disposed at a region that extends from the forefoot region F of the shoe to the midfoot region M and the outsole 6 is disposed at a region extends from the heel region H of the shoe to the midfoot region M. Both of the outsoles 5 and 6 are fixedly attached to the lower surface of the lower plate 4 or a stepped portion formed on the lower surface through bonding and the like.

Figure 9:
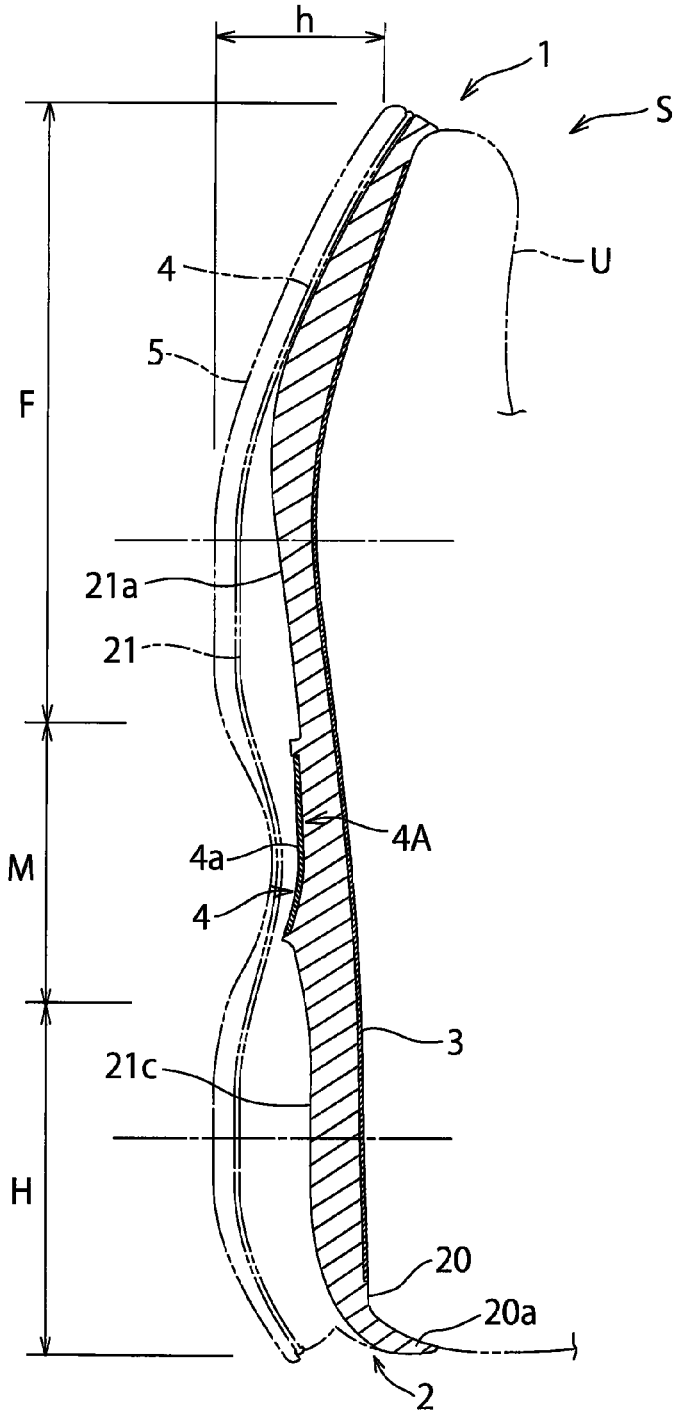
FIG. 9 is a longitudinal sectional view of FIG. 4 taken along line IX-IX.
Figure 10:
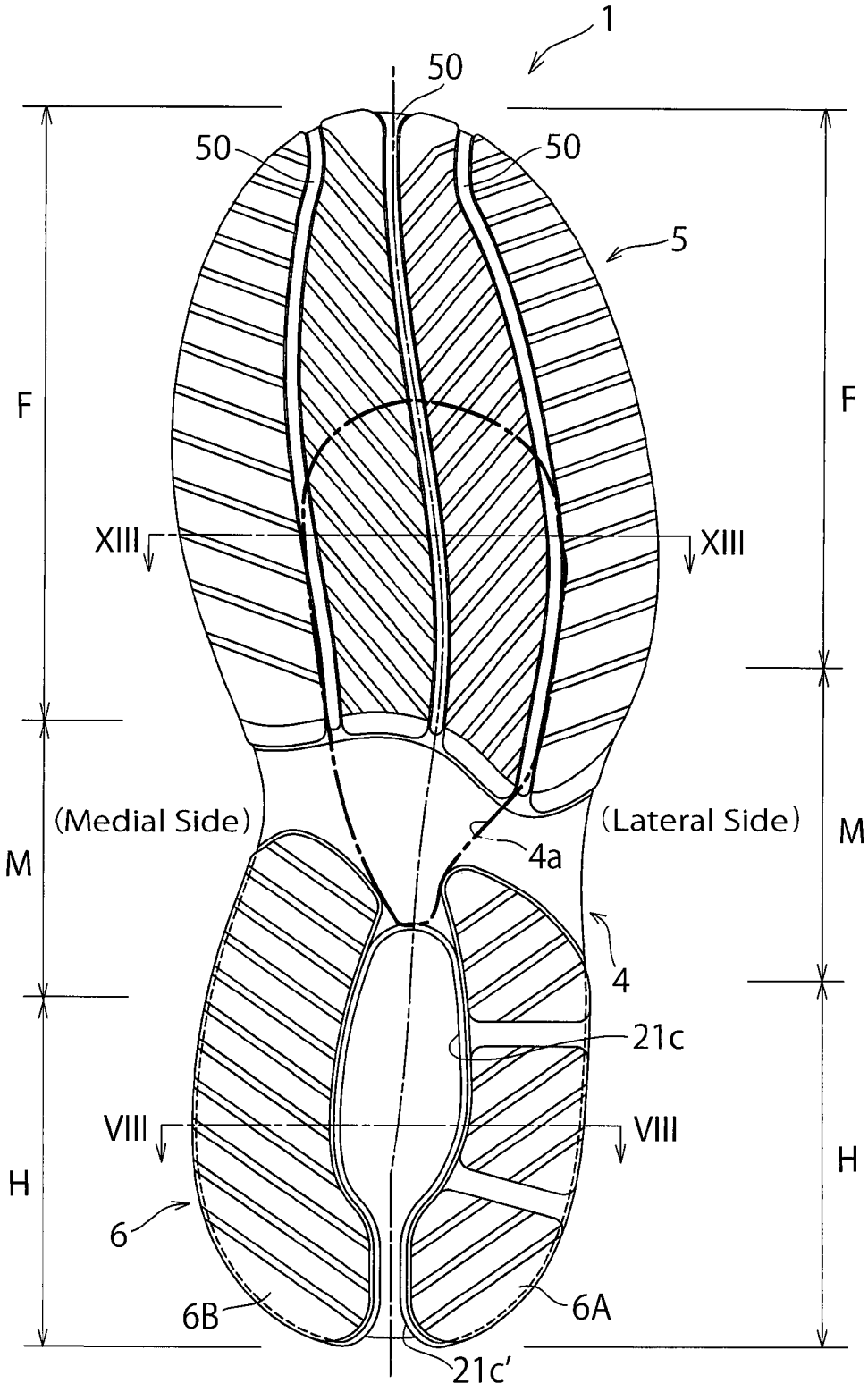
FIG. 10 is a bottom schematic view of the sole structure (for a left foot) according to another embodiment of the present invention.

On the bottom surface 21 of the midsole 2, at a region that extends from a longitudinal approximate mid-portion of the forefoot region F to the midfoot region M, there is formed a hollow portion 21*a* that curves upwardly (i.e. with a concave side of the curve facing toward the ground contact surface and a convex side of the curve facing away from the ground contact surface) and that extends in the longitudinal direction (see FIGS. 7 and 9). The hollow portion 21*a* is disposed at a lateral or transverse mid-portion of the midsole 2 i.e. at a mid-portion in the transverse direction. A front end of the hollow portion 21*a* extends to a position that corresponds to distal end portions of the third metatarsus $MB_3$ and the fourth metatarsus $MB_4$ (see FIG. 3). In this exemplification, a rear end of the hollow portion 21*a* extends to the midfoot region M beyond a rear end of the forefoot region F. Also, in this exemplification, an outer circumferential edge portion of the hollow portion 21*a* is in the shape of a longitudinally elongated deformed circle. The hollow portion 21*a* is disposed mainly at a position that corresponds to a second toe to a fourth toe of the foot and at a region at the rear of the second toe to the fourth toe. A position that corresponds to a first toe and a fifth toe of the foot and a large part of a region at the rear of the first toe and the fifth toe are disposed outside the hollow portion 21*a*.

Figure 4:
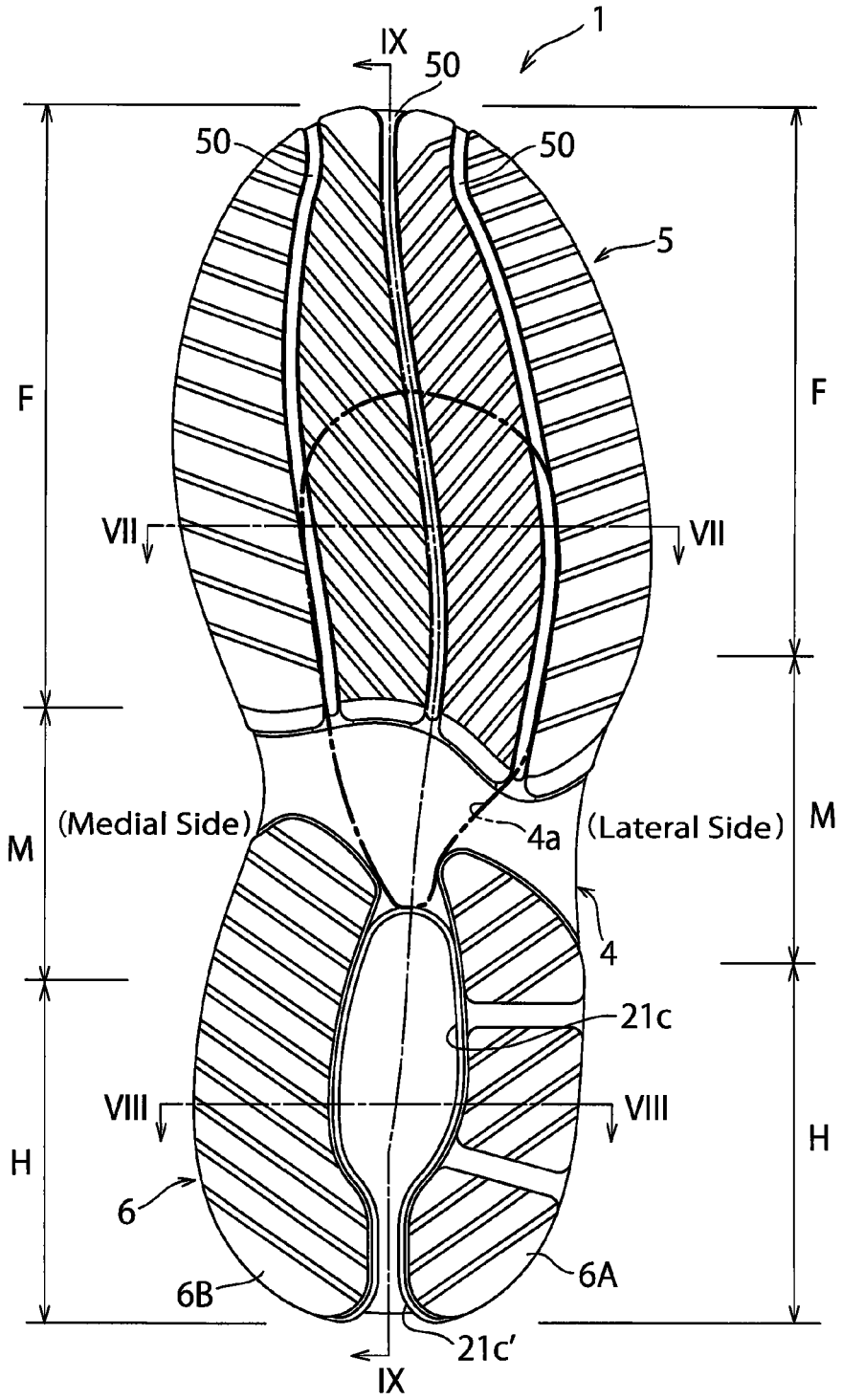
FIG. 4 is a bottom schematic view of the sole structure of FIG. 1.

As shown in FIGS. 4 and 5, the lower plate 4 has a concave portion 4*a* at a region corresponding to the hollow portion 21*a* of the midsole 2. That is, the concave portion 4*a* is disposed at a region that extends from the longitudinal approximate mid-portion of the forefoot region F to the midfoot region M at the lateral mid-portion of the midsole 2. The concave portion 4*a* curves upwardly concavely, i.e. with a concave side of the curve facing downwardly and a convex side of the curve facing upwardly (see FIG. 7) and extends longitudinally. In this embodiment, since the lower plate 4 is formed of a thin plate-like member, the lower plate 4 has a curved portion 4A (see FIG. 7) at a region extending from the longitudinal approximate mid-portion of the forefoot region F to the midfoot region M. The curved portion 4A has a lower surface that curves upwardly concavely and an upper surface that curves convexly, and the curved portion 4A extends longitudinally.

The midsole 2 is preferably formed of a soft elastic material, more specifically, thermoplastic resin such as ethylene-vinyl acetate copolymer (EVA) and the like, foamed thermoplastic resin, thermosetting resin such as polyurethane (PU) and the like, foamed thermosetting resin, rubber materials such as butadiene rubber, chloroprene rubber and the like, or foamed rubber materials. A hardness of the midsole 2 is set to, for example 40-60 C (specifically 50 C) in the Asker C scale.

The upper plate 3 is preferably formed of a harder elastic material than the midsole 2. More specifically, the upper plate 3 is formed of thermoplastic resin such as thermo plastic polyurethane (TPU), polyamide elastomer (PAE), acrylonitrile-butadiene-styrene (ABS) resin and the like, or thermosetting resin such as epoxy resin, unsaturated polyester resin and the like. Alternatively, the upper plate 3 may be formed of fiber reinforced plastics (FRP) that has carbon fibers, aramid fibers, glass fibers or the like as reinforced fibers and that has thermoplastic resin or thermosetting resin as matrix resin. In this embodiment, a hard elastic member is used in which upper and lower surfaces of TPU or PAE as such a member are covered with non-woven fabric. A hardness of the upper plate 3 is set to, for example 50-80D (specifically 67D) in the Asker D scale. Also, a thickness of the upper plate 3 is set to, for example 0.5-2 mm (specifically 1 mm).

Similar to the upper plate 3, the lower plate 4 is preferably formed of a harder elastic material than the midsole 2. More specifically, the lower plate 4 is formed of thermoplastic resin such as thermo plastic polyurethane (TPU), polyamide elastomer (PAE), acrylonitrile-butadiene-styrene (ABS) resin and the like, or thermosetting resin such as epoxy resin, unsaturated polyester resin and the like. Alternatively, the lower plate 4 may be formed of fiber reinforced plastics (FRP) that has carbon fibers, aramid fibers, glass fibers or the like as reinforced fibers and that has thermoplastic resin or thermosetting resin as matrix resin. A hardness of the lower plate 4 is set to, for example 50-80D (specifically 60D) in the Asker D scale. Also, a thickness of the lower plate 4 is set to, for example 0.5-3 mm (specifically 1.2 mm).

The outsole 5 is preferably formed of a hard elastic member that has a greater hardness than the midsole 2. More specifically, the outsole 5 is formed of thermoplastic resin such as ethylene-vinyl acetate copolymer (EVA) and the like, thermosetting resin such as polyurethane (PU) and the like, or rubber materials such as butadiene rubber, chloroprene rubber and the like. A hardness of the outsole 5 is set to, for example 50-90A (specifically 60-70 A) in the Asker A scale.

As shown in FIG. 7, the upper plate 3 extends laterally i.e. transversely in a flat shape at a region in which the hollow portion 21*a* is formed in the midsole 2. On laterally i.e. transversely opposite ends or sides (i.e. at a lateral side and a medial side) of the bottom surface 21 of the midsole 2, there are formed a pair of flat surfaces 21*b* that extend laterally i.e. transversely in an approximately flat shape. The flat surfaces 21*b* are disposed on laterally or transversely opposite sides of the hollow portion 21*a* that is formed at a transverse mid-portion of the bottom surface 21. The flat surfaces 21*b* are located at a position that corresponds to the first and fifth toes of the foot and at a region at the rear of the first and fifth toes. These flat surfaces 21*b* are provided such that when the load is transferred to the forefoot region F of the shoe the load applied to the forefoot region F can be stably supported by the laterally opposite ends of the midsole 2. Also, at this time, provision of the hollow portion 21*a* allows for a lateral arch of the forefoot region F to deform downwardly at the time of striking onto the ground, thus improving cushioning properties. The lower plate 4 has a pair of flat portions 4B on laterally opposite ends of the lower plate 4, which correspond to the flat surfaces 21*b* of the midsole 2. The flat portions 4B are disposed on laterally opposite sides of the curved portion 4A that is formed at a laterally mid-portion of the lower plate 4. Also, the flat portions 4B are preferably overlapped with laterally opposite ends of the upper plate 3 in a vertical direction. That is for causing less shearing-deformation of the midsole 2 in the vertical direction at the time of load application to the upper plate 3, to maintain moderate cushioning properties of the midsole 2 and to improve setting resistance.

As shown in FIG. 8, the upper plate 3 extends laterally i.e. transversely in a flat shape at the heel region H. The midsole 2 has a cushioning hole 21*c* formed at a lateral i.e. transverse mid-portion of the bottom surface 21 of the midsole 2. The cushioning hole 21*c* extends in the longitudinal direction. A front end of the cushioning hole 21*c* is connected with a rear end of the hollow portion 21*a* of the midsole 2 (see FIG. 9) and a rear end of the cushioning hole 21*c* opens to the heel rear end of the shoe through an opening 21*c*' (see FIG. 3) formed at the heel rear end. The opening 21*c*' is provided in order for the heel lateral side portion to easily deform at the time of an initial touch of the heel lateral side portion on the ground, thus improving cushioning properties at the time of the initial touch. On the lateral i.e. transverse opposite sides of the bottom surface 21 of the midsole 2, there are formed a pair of flat surfaces 21*b* that extend in an approximately flat shape in the lateral direction. The flat surfaces 21*b* are disposed on lateral opposite sides of the cushioning hole 21*c* formed at a lateral mid-portion of the bottom surface 21. The lower plate 4 has a pair of flat portions 4B on lateral opposite sides thereof, which correspond to the flat portions 21*b* of the midsole 2.

The lower plate 4, as shown in FIG. 5, has a plurality of (here, three) slits 40 that extend in a substantially longitudinal direction and disposed away from each other in the lateral direction at a region extending from the forefoot region F to the midfoot region M. The lower plate 4 is divided into a plurality of (here, four) substantially longitudinally extending band-shaped sections by the slits 40 at the region extending from the forefoot region F to the midfoot region M. On an upper surface of each of the band-shaped sections, a protruded rib 41 is provided extending along the band-shaped section. The rib 41 is provided in order for the lower plate 4 to be less flexible, but it can be omitted. The lower plate 4 has a longitudinally extending aperture 4*c* formed at the heel region H. The aperture 4*c* is disposed at a position corresponding to the cushioning hole 21*c* of the midsole 2. A front end of the aperture 4*c* is connected with a rear end of the concave portion 4*a* and a rear end of the aperture 4*c* opens to the heel rear end of the shoe through an opening 4*c*' formed at the heel rear end.

On the bottom surface 21 of the midsole 2, as shown in FIG. 6, there are formed a plurality of (here, four) narrow grooves 22 that extend in the substantially longitudinal direction and spaced away from each other in the lateral direction at a region extending from the forefoot region F to the midfoot region M. These grooves 22 are provided in such a manner that when the upper surface of the lower plate 4 is fitted to the bottom surface 21 of the midsole 2 the ribs 41 of the lower plate 4 engage with the corresponding grooves 22. Therefore, the grooves 22 have positioning function relative to the lower plate 4. Between the adjacent grooves 22, a wide groove 21*d* is formed extending in the substantially longitudinal direction (see FIG. 7). These grooves 21*d* are provided for facilitating downward deformation of the forefoot region of the midsole 2 to improve cushioning properties at the time of the load's transfer to the forefoot region of the shoe during running. In this embodiment, the grooves 21*d* extend to the tip end of the toe portion of the midsole 2. On the bottom surface 21 of the midsole 2 at the heel region H, there is formed one or plural grooves 21*e* (see FIG. 1) that opens to the lateral side of the midsole 2 and that extends to the cushioning hole 21*c*. The grooves 21*e* are provided for the heel lateral side portion of the midsole 2 to easily deform to improve cushioning properties at the time of a heel-lateral-side's impact onto the ground.

The outsole 5, as shown in FIG. 4, has a plurality of (here, three) grooves 50 that extend in the substantially longitudinal direction and that are spaced away from each other in the lateral direction at the forefoot region F to the midfoot region M. The outsole 5 is divided into a plurality of (here, four) substantially longitudinally extending band-shaped sections by the grooves 50 at the forefoot region F to the midfoot region M of the outsole 5. These band-shaped sections of the outsole 5 correspond to the band-shaped sections of the lower plate 4, respectively. The outsole 6 extending from the heel region H to the midfoot region M is formed of a lateral side portion 6A disposed on the lateral side and a medial side portion 6B disposed on the medial side.

Also, as shown in FIG. 9, an upper U is fitted to the sole structure 1 of the present embodiment to assemble a shoe S. A toe spring h of the assembled shoe S, which is a height from a floor to the tip end of the toe when the shoe S is placed on a horizontal floor, is set to, for example 20-60 mm.

According to the above-mentioned sole structure 1, since the midsole 2 has the hollow portion 21*a* curved upwardly concavely and extending longitudinally at the lateral mid-portion of the midfoot region M of the shoe S and the upper and lower plates 3, 4 are provided above and below the midsole 2, the forefoot region of the midsole 2 can be restrained from bending, thus restraining bending of the forefoot region of the sole structure 1, such that thereby reducing the burden on the MP (Metatarsophalangeal) joints and the knee joint during running. As a result of this, especially, when a person of a large constitution runs slowly, he/she will be able to run without imposing the burden on the body. Also, by setting the toe spring h to a relatively high value, even when bending of the MP joint is restrained, an angle of the foot can be changed according to the weight transfer and the runner will thus be able to run in a smooth manner without breaking the conjunction with the motion of the foot. Moreover, in this case, since the soft midsole 2 is provided between the upper and lower plates 3, 4, cushioning properties can be improved as the load is transferred to the forefoot region F.

Furthermore, in the sole structure 1, since the lower plate 4 of a hard elastic member has the concave portion 4*a* corresponding to the hollow portion 21*a* of the midsole 2, this concave portion 4*a* can further restrain bending of the forefoot region of the sole structure 1.

First Alternative Embodiment

In the above-mentioned embodiment, an example was shown in which the midsole 2 is disposed along the entire length of the shoe extending from the heel region H through the midfoot region M to the forefoot region F of the shoe, but the sole structure 1 of the present invention has also application to a sole structure in which the midsole 2 is disposed at least at the forefoot region F of the shoe.

Second Alternative Embodiment

In the above-mentioned embodiment, as a preferred embodiment, an example was shown in which the lower plate 4 has the concave portion 4*a* corresponding to the hollow portion 21*a* of the bottom surface 21 of the midsole 2, but in the present invention, the midsole 2 has only to include the hollow portion 21*a*. For example, the present invention can also be applied to an example in which the lower plate 4 has a flat portion on laterally opposite portions of the forefoot region of the lower plate 4 and has a hole, not a concave portion, on the laterally mid-portion.

Third Alternative Embodiment

In the above-mentioned embodiment, an example was shown in which the front end of the hollow portion 21*a* formed in the bottom surface 21 of the midsole 2 extends to a position corresponding to the distal end portions of the third metatarsus $MB_3$ and the fourth metatarsus $MB_4$, but the front end of the hollow portion 21*a* may extend not only to the distal end portions of the third metatarsus $MB_3$ and the fourth metatarsus $MB_4$ but also to the distal end portion of the second metatarsus $MB_2$. Alternatively, the front end of the hollow portion 21*a* may extend to the position corresponding to the tip end of the toe of the shoe wearer's foot.

Fourth Alternative Embodiment

In the above-mentioned embodiment, an example was shown in which the rear end of the hollow portion 21*a* of the midsole 2 extends to the midfoot region M beyond the rear end of the forefoot region F, but the rear end of the hollow portion 21*a* has only to extend to the rear end of the forefoot region F. In addition, the rear end of the hollow portion 21*a* may extend to the heel region H.

Fifth Alternative Embodiment

In the above-mentioned embodiment, an example was shown in which the shape of the outer circumferential edge portion of the hollow portion 21*a* of the midsole 2 is formed in the shape of a longitudinally extending deformed elongated circle, but the shape of the hollow portion 21*a* is not limited to such a deformed elongated circle and can employ any suitable shape such as a spindle shape, a fusiform, a fan shape, a rectangular shape, a trapezoidal shape and the like.

Sixth Alternative Embodiment

In the above-mentioned embodiment, an example was shown in which the forefoot region of the lower plate 4 is divided in the lateral direction by the slits 40 extending in the substantially longitudinal direction, but the present invention is not restricted to such an example. An elongated hole extending in the substantially longitudinal direction and piercing through the lower plate 4 may be employed in lieu of the slit 40.

Seventh Alternative Embodiment

In the above-mentioned embodiment, an example was shown in which the forefoot region of the lower plate 4 is divided in the lateral direction by the slits 40 extending in the substantially longitudinal direction, but the present invention is not restricted to such an example. FIGS. 10 to 13 show an alternative embodiment of the present invention. In these drawings, like reference numbers indicate identical or functionally similar elements.

Figure 11:
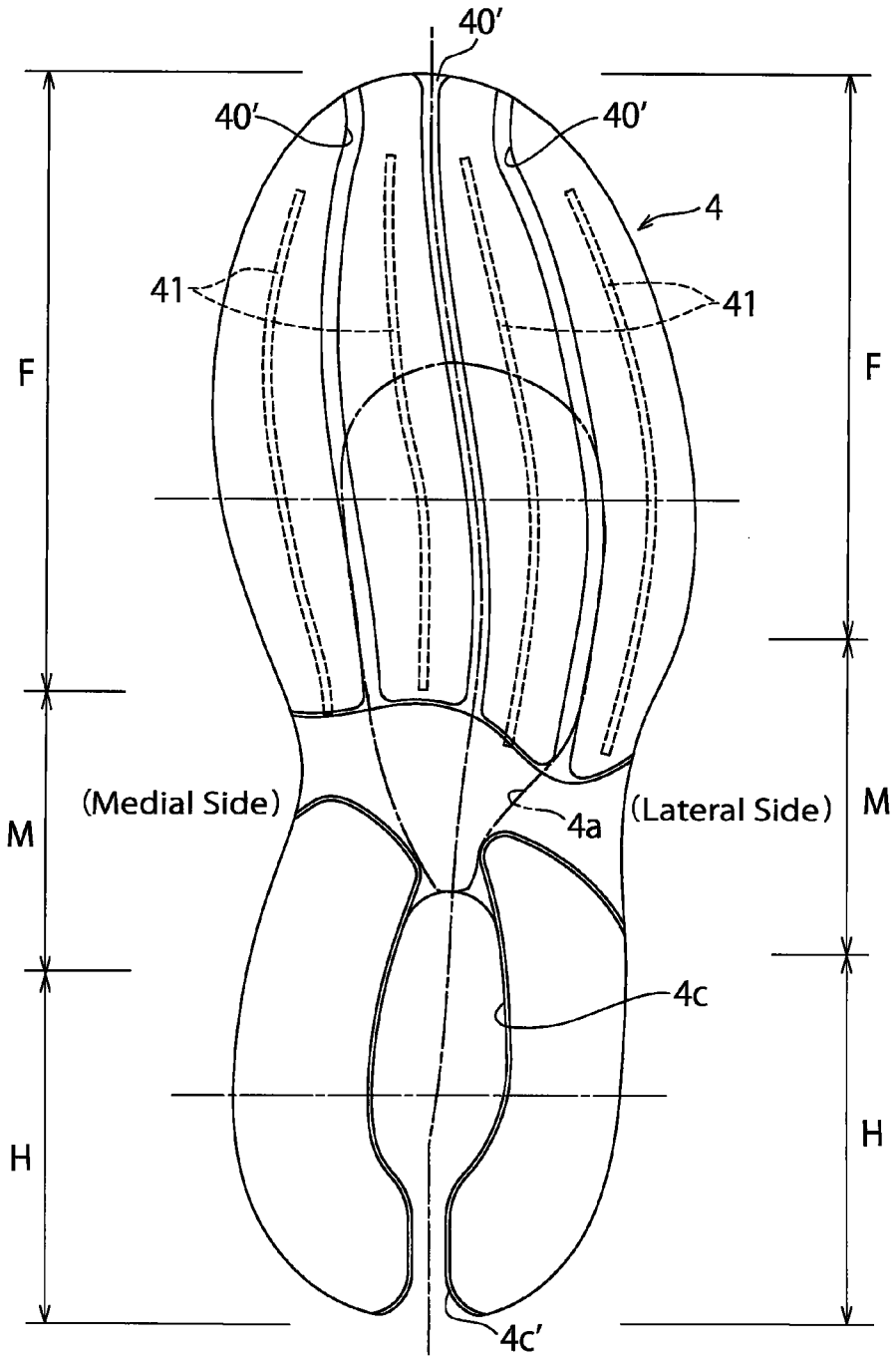
FIG. 11 is a bottom schematic view of the lower plate constituting the sole structure of FIG. 10, illustrating the state in which the outsole, midsole and upper plate were removed from the structure of FIG. 10.
Figure 12:
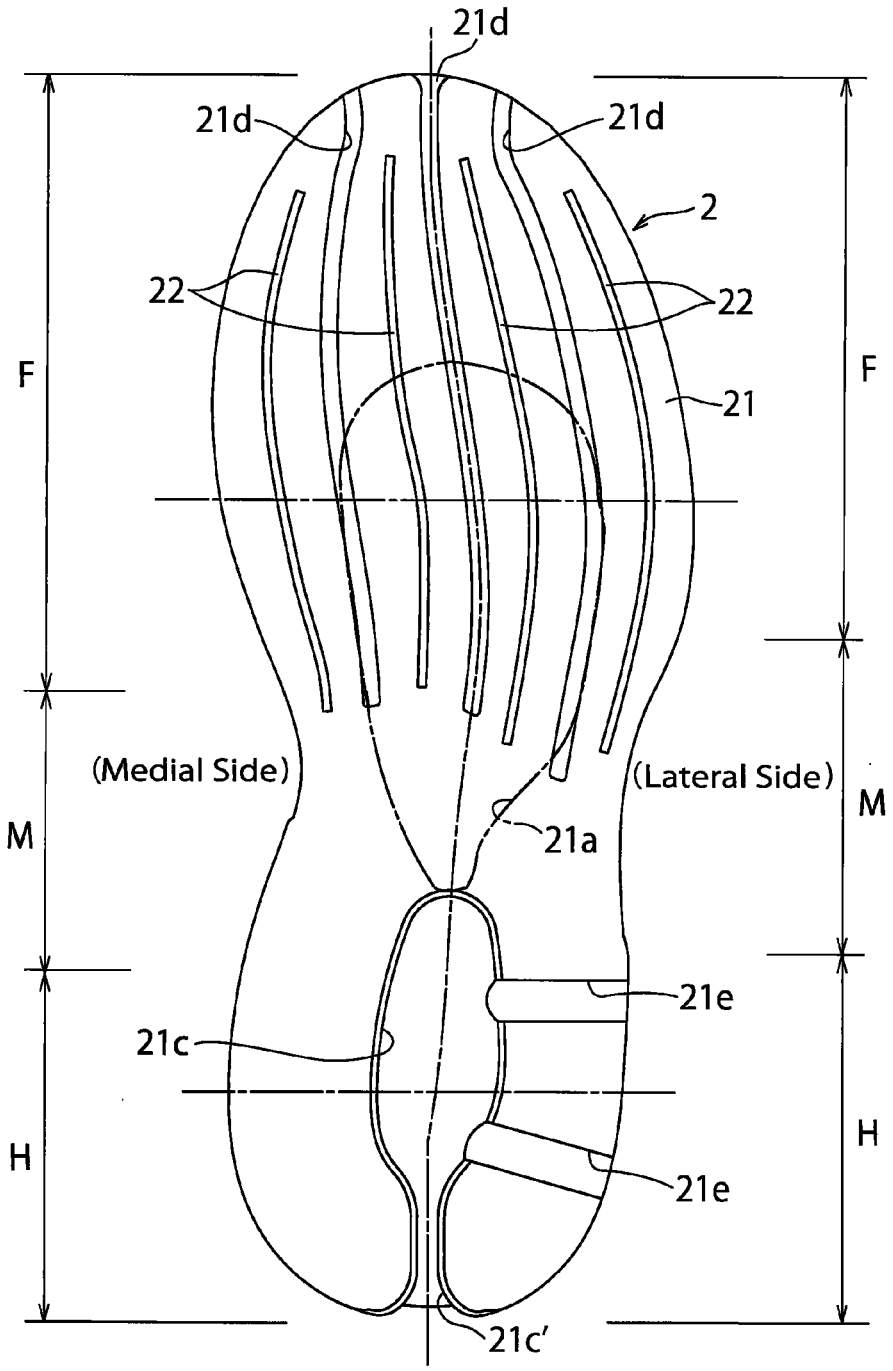
FIG. 12 is a bottom schematic view of the midsole constituting the sole structure of FIG. 10, illustrating the state in which the outsole, and the upper and lower plates were removed from the structure of FIG. 10.

As shown in FIG. 11, the lower plate 4 has a plurality of (here, three) grooves 40' that extend in the substantially longitudinal direction. These grooves 40' are disposed at positions that respectively correspond to the plurality of slits 40 in the above-mentioned embodiment. In addition, it is similar to the above-embodiment that the lower plate 4 has a plurality of ribs 41 formed on the upper surface thereof, the outsole 5 has a plurality of grooves 50 formed thereon, and the midsole 2 has a plurality of grooves 21*d*, 22 formed on the bottom surface 21 thereof (see FIGS. 10 and 12).

Figure 13:
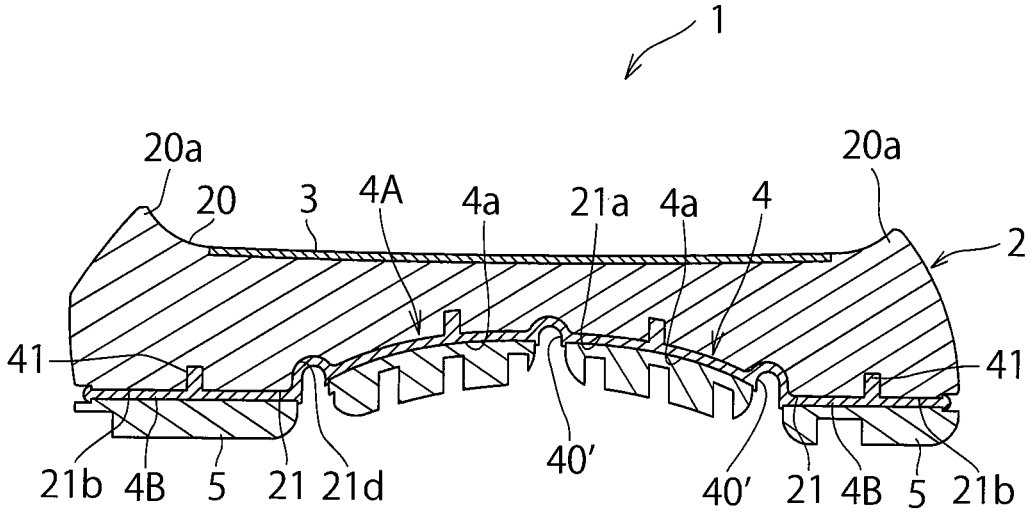
FIG. 13 is a cross sectional view of FIG. 10 taken along line XIII-XIII.

As shown in FIG. 13, the lower plate 4 is consecutively connected in a row without being divided in the lateral direction. Each of the groove forming portions engages with the groove 21*d* on the bottom surface 21 of the midsole 2.

Eighth Alternative Embodiment

In the above-mentioned embodiment, an example was shown in which the forefoot region of the lower plate 4 has a plurality of slits 40 formed therein, and in the seventh alternative embodiment, an example was shown in which the forefoot region of the lower plate 4 has a plurality of grooves 40' formed thereon, but these slits 40 and grooves 40' may be single. In this case, a single slit 40 or a single groove 40' may be disposed at a laterally central position of the forefoot region of the lower plate 4.

Other Application

In the above-mentioned embodiment, an example was shown in which the sole structure was applied to the running shoe, but the present invention also has application to an ordinary shoe such as a walking shoe, a nursing shoe, a rehabilitation shoe and the like, as well as a sports shoe such as a running shoe, a jogging shoe and the like.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A shoe comprising a sole structure, said sole structure comprising:

an upper plate disposed at least at a forefoot region of said shoe;

a lower plate disposed under and spaced away from said upper plate; and a midsole that extends along an entire width of said forefoot region of said shoe, and that is interposed between said upper plate and said lower plate, and that is softer than said upper plate and said lower plate, wherein said midsole has a hollow portion that is upwardly concavely curved at a transverse mid-portion of said midsole and that extends longitudinally in a longitudinal direction of said shoe.

2. The shoe according to claim 1, wherein said lower plate has a concave portion that corresponds to said hollow portion of said midsole.

3. The shoe according to claim 1, wherein each of said lower plate and said midsole has a pair of flat surfaces at transversely opposite sides thereof.

4. The shoe according to claim 1, wherein said upper plate extends transversely in a flat shape at a transverse mid-portion of said upper plate.

5. The shoe according to claim 1, wherein a front end of said hollow portion of said midsole extends to a position of said shoe that is located and adapted to correspond to locations of distal ends of metatarsi of a third toe and a fourth toe of a foot of a person who wears said shoe.

6. The shoe according to claim 1, wherein a front end of said hollow portion of said midsole extends to a position of said shoe located and adapted to correspond to a location of a tip end of a toe of a foot of a person who wears said shoe.

7. The shoe according to claim 1, wherein a rear end of said hollow portion of said midsole extends to a rear end of said forefoot region.

8. The shoe according to claim 1, wherein said midsole extends to a midfoot region of said shoe and a rear end of said hollow portion of said midsole extends to said midfoot region.

9. The shoe according to claim 1, wherein said lower plate has a groove or a slit that extends longitudinally in the longitudinal direction of said shoe.

10. The shoe according to claim 9, wherein said lower plate has said groove that extends longitudinally.

11. The shoe according to claim 10, wherein said groove does not penetrate through a thickness of said lower plate, and said lower plate remains continuous and undivided transversely across said groove at said forefoot region of said shoe.

12. The shoe according to claim 10, wherein said lower plate has a plurality of said grooves that extend longitudinally and that are spaced apart from one another transversely at said forefoot region of said shoe.

13. The shoe according to claim 1, wherein said shoe has a toe spring height in a range from 20 to 60 mm measured vertically from a tip end of a toe of said shoe to a horizontal plane extending along a ground contact surface of said sole structure.

14. The shoe according to claim 9, wherein said lower plate has said slit that extends longitudinally.

15. The shoe according to claim 14, wherein said slit penetrates through a thickness of said lower plate and divides said lower plate into plural longitudinally-extending sections of said lower plate on transversely opposite sides of said slit at said forefoot region of said shoe.

16. The shoe according to claim 14, wherein said lower plate has a plurality of said slits that extend longitudinally and that are spaced apart from one another transversely at said forefoot region of said shoe.

17. The shoe according to claim 1, wherein said midsole extends continuously along the entire width of said forefoot region of said shoe.

18. The shoe according to claim 1, wherein said lower plate is spaced away and separated from said upper plate at said transverse mid-portion, with said midsole interposed between said upper plate and said lower plate at said transverse mid-portion.

19. A shoe comprising a sole structure that comprises:

an upper plate disposed at a forefoot region of the shoe;

a lower plate disposed under and spaced away from said upper plate; and a midsole interposed between said upper plate and said lower plate;

wherein:

said upper plate and said lower plate respectively include plate portions that are spaced away from one another at a transverse middle area of said sole structure, said midsole includes a transverse mid-portion of said midsole interposed between said plate portions of said upper plate and said lower plate in said transverse middle area of said sole structure, said midsole is softer than said upper plate and said lower plate, and said midsole has a bottom surface including a concavity that has a downwardly facing concave surface and that extends longitudinally in a longitudinal direction of said shoe at said transverse mid-portion of said midsole in said transverse middle area of said sole structure.

20. The shoe according to claim 19, wherein said lower plate includes an upwardly curved portion that contacts and extends along said concave surface of said concavity of said midsole.

* * * * *